US006603862B1

(12) United States Patent
Betts

(10) Patent No.: US 6,603,862 B1
(45) Date of Patent: Aug. 5, 2003

(54) SPHERICAL LOUDSPEAKER SYSTEM

(75) Inventor: Robert W. Betts, Shelton, CT (US)

(73) Assignee: Sonic Systems, Inc., Stratford, CT (US)

( * ) Notice: Subject to any disclaimer, the term of this patent is extended or adjusted under 35 U.S.C. 154(b) by 0 days.

(21) Appl. No.: 09/426,262

(22) Filed: Oct. 25, 1999

Related U.S. Application Data

(60) Provisional application No. 60/107,587, filed on Nov. 9, 1998.

(51) Int. Cl.[7] ..... H04R 1/02

(52) U.S. Cl. ..... 381/336; 381/160; 181/155

(58) Field of Search ..... 381/160, 182, 381/186, 345, 87, 350, 352; 181/153, 155, 156, 198, 199, 149, 150, 151

(56) References Cited

U.S. PATENT DOCUMENTS 4,989,254 A * 1/1991 Amalaha ..... 381/182
5,268,538 A * 12/1993 Queen ..... 181/144
5,306,880 A * 4/1994 Coziar et al. ..... 181/149

* cited by examiner

*Primary Examiner*—Curtis Kuntz
*Assistant Examiner*—Brian Ensey
(74) *Attorney, Agent, or Firm*—Melvin I. Stoltz

(57) ABSTRACT

By providing a spherically shaped housing or enclosure containing one or more drivers or speakers motors, and cooperatively mounting the housing in association with a uniquely constructed reflector, a spherical loudspeaker system is achieved which controls and shapes the ultimate acoustical waveform produced thereby. The loudspeaker system of the present invention controls and distributes the acoustical energy of the driver and housing, while shaping the acoustical energy field into a true hemispherical pattern, within the system's power bandwidth. By employing the present invention, the point of summation of the hemispherical pattern is approximately eight times the diameter of the reflector, thereby achieving the desired hemispherical polar coverage patterns.

12 Claims, 6 Drawing Sheets

SPHERICAL LOUDSPEAKER SYSTEM

This application is related to U.S. Provisional Patent Application, Ser. No. 60/107,587, filed Nov. 9, 1998 for a Spherical Loudspeaker System.

TECHNICAL FIELD

This invention relates to loudspeaker systems and, more particularly, to loudspeaker systems for generating hemispherical sound wave patterns.

BACKGROUND ART

Loudspeakers are widely used for providing projection of voice and music in a variety of areas and for numerous purposes. One area in which loudspeakers are particularly important and have had substantial difficulty in providing good results is in large public areas. In such locations, the use of conventional loudspeakers is common, but there are difficulties because of the directional nature of the speakers' sound projection. As a result, in order to assure maximum coverage, numerous or multiple speakers are employed with overlapping coverage areas which requires proper engineering and often considerable expense to attain the desired results.

In an attempt to reduce the necessity of having numerous loudspeaker components installed to provide the desired coverage, loudspeakers having a hemispherical coverage pattern have been developed. Although many of these prior art loudspeakers had been able to provide a projection of voice and music over a wider listening area, numerous problems have continued to exist in producing products which achieve a true full frequency hemispherical sound projection pattern from a single overhead sound source.

One of the principal problems which has plagued prior art spherical loudspeakers as well as conventional loudspeakers centers on the physical characteristics of acoustic wave patterns. In this regard, audio frequencies essentially occupy 11 octaves of the electromagnetic spectrum, with acoustical wave lengths varying across a ratio of more than 2000 to 1 (about 113 feet to about ½ in.). In most applications, a more reasonable and workable ratio is 1000 to 1 (about 56 feet to 0.68 inches). Regardless of which ratio is employed, it is apparent, due to their very nature, that these extremes of wavelength energy require the application and use of completely different areas and aspects of the laws of physics.

Another problem inherent in providing optimum projection of voice and music is the fact that lower frequencies of the audio spectrum produce spherical waves which tend to be fluid in nature and difficult to control in terms of shaping and directing. Furthermore, higher frequencies develop planar waves which exhibit directional characteristics and are, by their very nature, not easily dispersed or diffused into broad coverage patterns. Finally, midrange frequencies produce various combinations of these two extremes.

In attempting to overcome these prior art problems, while also providing maximum area coverage, spherical loudspeaker systems with shaped dishes or "reflectors" suffer from one or more shortcomings. One such common problem is a severe decrease of high frequency energy distribution at the wider points of coverage, typically beginning at about 45 degrees from the central axis. Another common problem is a significant increase in phase distortion from unwanted multiple reflections occurring between the sound source and the reflector, as well as a significant increase intermodulation distortion due to the remodulation of one-wave by another of a different frequency. Finally, high intensity lobes of acoustic energy are often produced directly on axis with the reflector, expanding as wide as 20 to 30 degrees from the central axis.

SUMMARY OF THE INVENTION

By employing the present invention, all of the difficulties and drawbacks of prior art loudspeaker constructions are eliminated and a true hemispherical sound pattern producing loudspeaker system is achieved which controls and shapes the ultimate acoustical waveform produced thereby. In the present invention, a loudspeaker system is provided which incorporates a spherically shaped loudspeaker and/or closure containing one or more drivers or speaker motors. In most applications, a high frequency speaker or driver is employed in combination with a low frequency driver. In addition, a uniquely constructed reflector is employed which is mounted in cooperative association with the spherical enclosure. In this way, the system of the present invention controls and distributes the acoustical energy of the driver, while shaping the acoustical energy field in a true hemispherical pattern, within the systems power bandwidth. By employing the present invention, the point of summation of the hemispherical pattern is approximately eight times the diameter of the reflector, thereby achieving the desired hemispherical polar coverage patterns.

In the preferred construction, the reflector of the present invention is designed to be rigidly and mechanically attached to the spherical cabinet forming the loudspeaker or, alternatively, built into the construction of the sphere during the fabrication or molding process as a homogeneous or integral component thereof. The center or apex of the reflector is intended to be physically close to and acoustically intimately coupled with the geometric center of the driver's diaphragm.

In addition, the reflector also incorporates uniquely designed and shaped vanes formed on the surface thereof which enhance the output from the reflector by distributing the high frequency energy out to the roader angles of the coverage pattern. In the preferred embodiment, the vanes are constructed as secondary reflector vanes and comprise an exponential cross-section that is continuously variable over their entire length. In the preferred construction, the axial profile of the vanes is also exponential.

By employing the present invention, a loudspeaker system is achieved which controls and defines the wave shape and coverage patterns of the various frequency bandwidths, utilizing the natural characteristics of the wave itself, with no forced or artificial control. Using the three basic elements of a loudspeaker system—(1) the driver, (2) the spherical enclosure, and (3) the reflector—in a unique integral design, a synergistic interaction of these components is achieved which produces true hemispherical coverage patterns across the entire rated power bandwidth of the loudspeaker.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying the drawings, in which.

Figure 6:
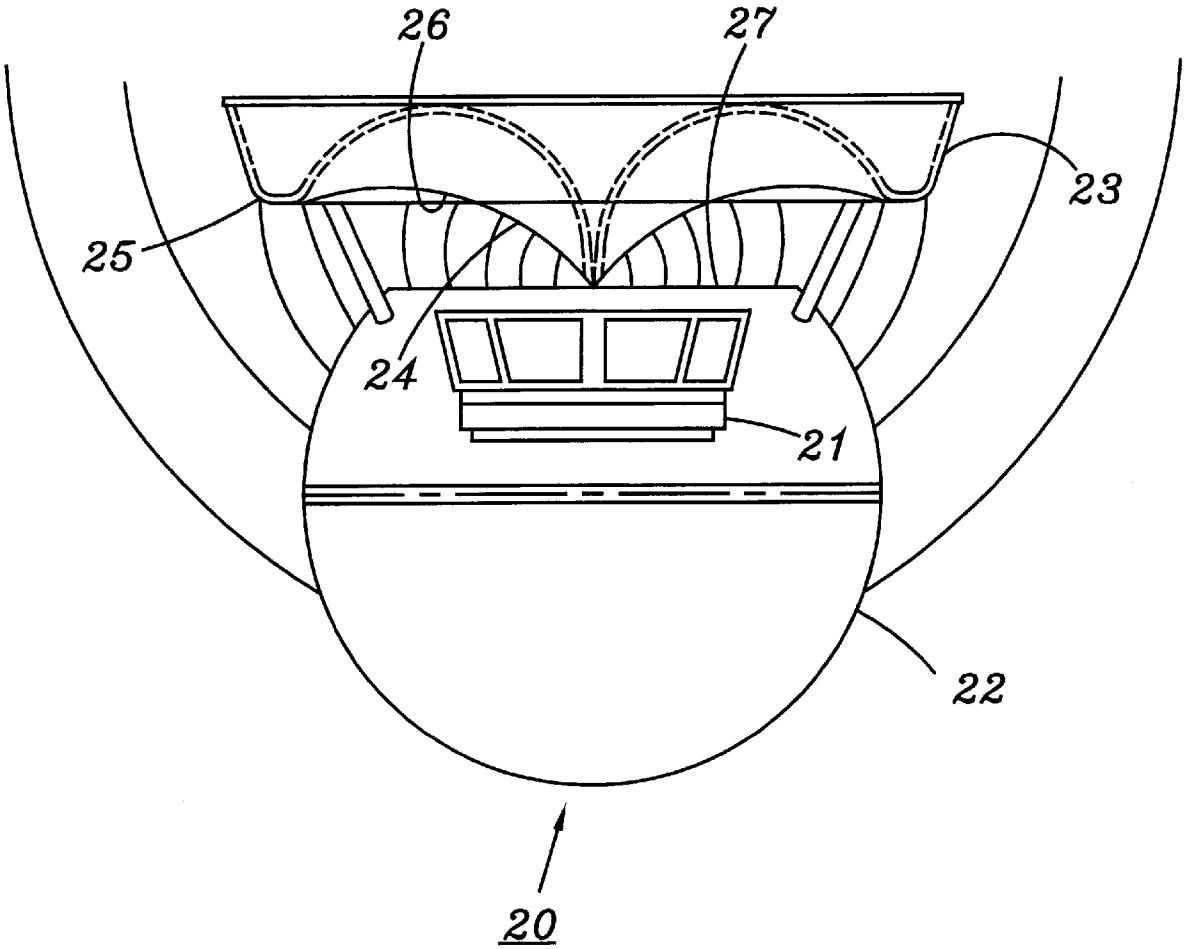
Figure 7:
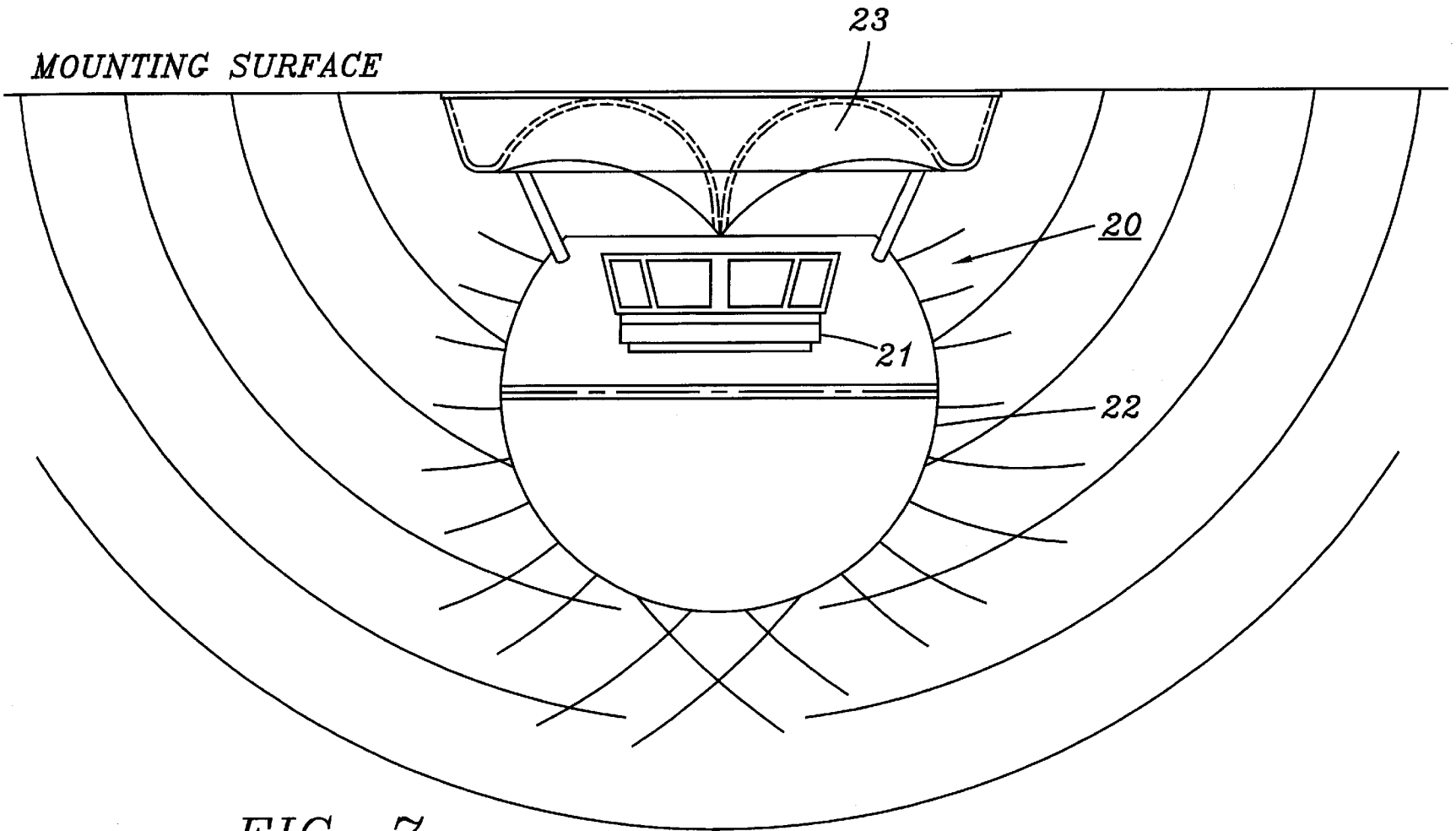

FIG. 6 is a side elevation view, partially in cross-section, depicting the spherical loudspeaker system of the present invention and diagrammatically depicting the acoustical phenomenon of exponential expansion and linear unity loading of the present invention; and FIG. 7 is a side elevation view, partially in cross-section, depicting the spherical loudspeaker system of the present invention and diagrammatically depicting the hemispherical wave pattern produced by the summation of the acoustical phenomenon of the present invention.

DETAILED DESCRIPTION

By referring to FIGS. 1–7, along with the following detailed discussion, the overall construction and operation of the present invention can best be understood. As will become evident to one of ordinary skill in the art, FIGS. 1–7 depict the preferred embodiment of the present invention. However, alternate constructions and variations of this invention can be made without departing from the scope of this invention. Consequently, it is to be understood that the construction shown in FIGS. 1–7 is provided for exemplary purposes only and is not intended to limit the present invention thereto.

As is well-known in the industry, every speaker system's performance is affected by seven basic acoustical modes of operation. These seven modes are reflections, diffraction, refraction, diffusion, coupling, loading, and summation. In order to produce a true hemispherical wavefront from a single loudspeaker enclosure, each of these modes must be carefully balanced and applied to the designs. Since many of these modes are competing, each must be in their own unique characteristic way, as they apply to the wavelength of the frequency being transmitted. By integrating these acoustical modes as well as the inherent natural wavefront shape of various frequencies, the desired operation and preferred wavefront pattern can be created.

As shown in FIGS. 1–7, loudspeaker system 20 of the present invention comprises at least one driver 21, spherical enclosure 22 and cooperatively associated reflector 23. In the present invention, driver 21 is designed for optimum sensitivity or efficiency, bandwidth or frequency response, linearity or flatness of response, transient response, lack of distortion or coloration, power handling and maximum sound pressure level capability. In order to function in the intended manner, all of these qualities must be present in speaker or driver 21, since spherical enclosure 22 and cooperating reflector 23 function as passive wave shaping and controlling devices, and cannot add to the purity, quality or fidelity of the acoustical signal generated by driver 21.

In addition, in the preferred embodiment, driver 21 comprises a low frequency driver and a high frequency driver both of which are mounted together in juxtaposed, spaced, cooperating relationship. Preferably, high frequency drivers and low frequency drivers are mounted in coaxial alignment, thereby enabling the acoustical energy field produced thereby to be efficiently and effectively shaped by spherical enclosure 22.

While the particular shape of reflector 23 is unique and represents a substantial aspect of the present invention, the physical construction of spherical enclosure 22 and reflector 23 employ generally well known forming technology in order to achieve the desired shape and the desired diameter. Typically, spherical enclosure 22 and/or reflector 23 may be formed from a wide variety of fabrication materials. Although any desired material may be employed, the preferred materials for fabricating spherical enclosure 22, and reflector 23 comprises one selected from the group consisting of fiberglass, plastics, structural foams, aluminum bonded to sound dampening materials, and steel bonded to sound dampening materials. In addition, although a wide variety of plastics may be effectively employed, the preferred plastics for forming these components are selected from the group consisting of acrylics, styrenes, polyvinyl chlorides and polycarbonates.

In addition, in the preferred embodiment, enclosure 22 is constructed with a portal 27 formed therein. Furthermore, driver 21 is mounted in association with portal 27 for enabling the sound waves generated by drive 21 to pass through portal 27 to reflector 23.

Finally, in completing the construction of loudspeaker system 20, spherical enclosure 22 is mounted directly to reflector 23 with portal 27 of enclosure 22 positioned in close proximity to reflector 23. In order to provide and maintain the desired relative positions of enclosure 22 and reflector 23, mounting struts 28 are preferably employed. As depicted, struts 28 extend between reflector 23 and enclosure 22, fixedly maintaining these components in the precisely desired cooperating positions.

Figure 1:
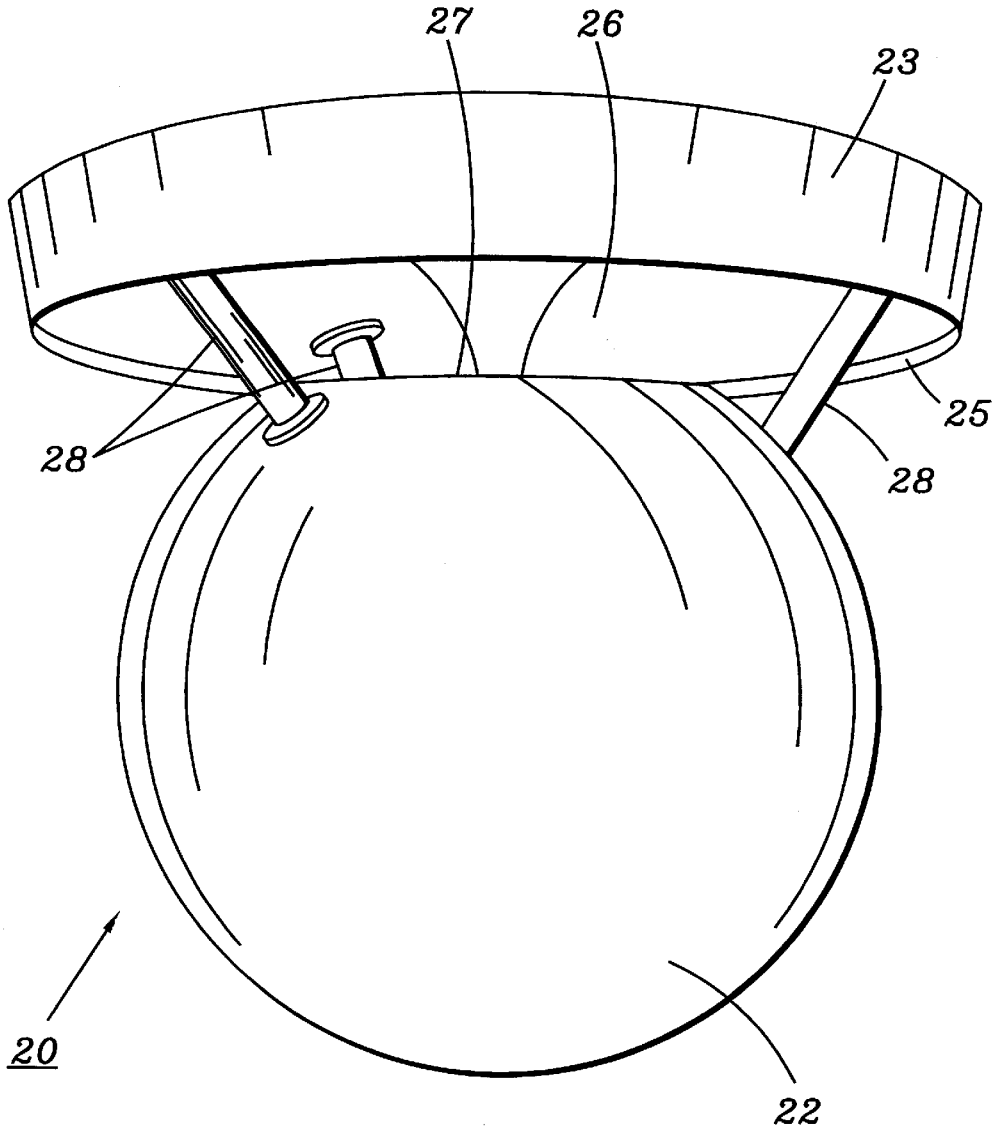
FIG. 1 is a perspective view of the spherical loudspeaker system of the present invention.
Figure 2:
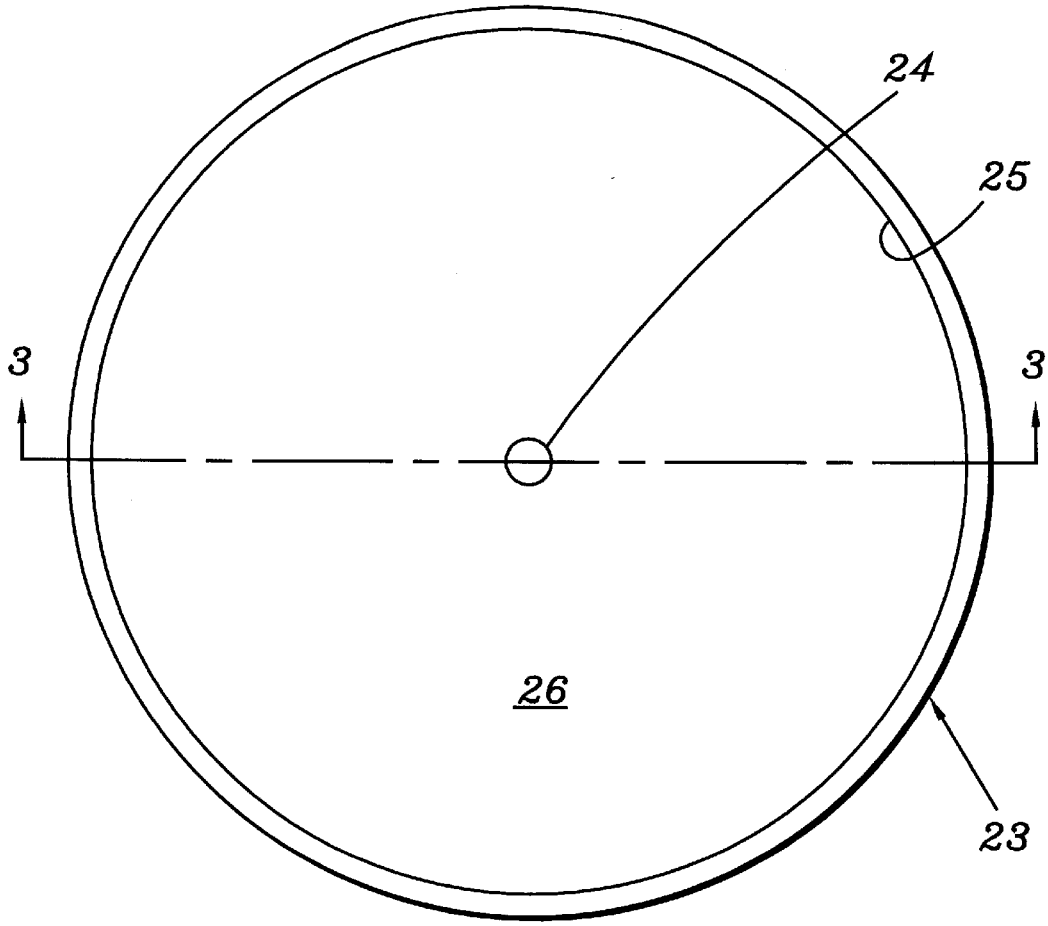
FIG. 2 is a plan view of the reflector portion of the loudspeaker system of the present invention.
Figure 3:
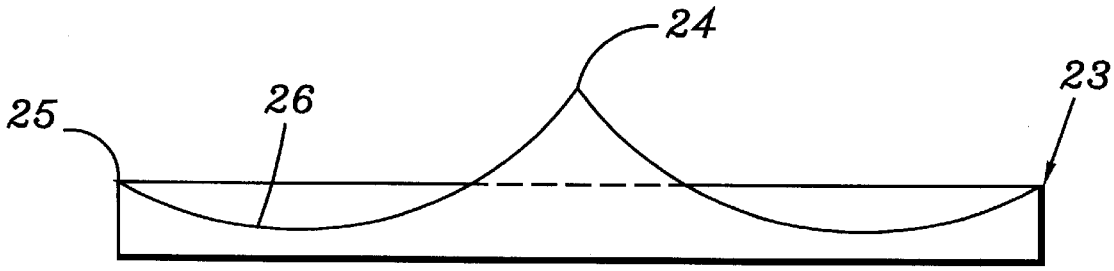
FIG. 3 is a cross-sectional side elevation view of the reflector portion of the loudspeaker system taken along the line 3—3 of FIG. 2.

As stated above, reflector 23 is a principal component of the present invention in providing the desired hemispherical wavefront. As best seen in FIGS. 1–3, reflector 23 comprises an overall circular shape having a radial concave shaped surface 26 extending from apex 24 at the center thereof and terminating at outer peripheral rim 25. As depicted in FIGS. 1–3, the cross-sectional profile forming radical concave shaped surface 26 is not linear, but comprises a geometric form which defines an exponentially progressive curve. The form of the curve begins at the center of apex 24 of reflector 23 and proceeds in a radial fashion outwardly to rim 25. The curve is symmetrical both radially and annularly about the entire circumference of reflector 23.

In accordance with the present invention, the progression of radially extending concave shaped surface 26 of reflector 23 comprises a form/factor that is complementary to spherical enclosure 22. Since the diameter of the spherical enclosure 22 is fixed, the diameter thereof becomes the reference baseline for calculating the profile shape of surface 26 of reflector 23. Since the shape of surface 26 comprises a continuous exponentially progressive curve, the exponential form must become a variable in its progression in order to affect the desired result. This continuous exponential curve is best defined by the following formula:

$$De=(P_1I)^k, (P_2I)^k \ldots (P_nI)^k$$

where: De=Linear axial distance between reflector and sphere at any incremental position along the acoustical path.

and: $P_1, P_2 \ldots P_n$=Linear axial distance of any previous (numbered) De and: $^k$=wavelength coefficient factor (in exponential form). Expressed as the expansion factor of the prime parameter $$\frac{A_C}{P_L}$$

where: $A_C$=coupling; area of cross section and: $P_L$=loading; pressure units per area unit when: I=a fixed linear increment.

In addition, any linear distance between reflector 23 and spherical enclosure 22, at any mutual point along the radial dimension, is a numerical factor in the exponential progression. Accordingly, the specific exponential shape of surface 26 of reflector 23, along with reflecting ray patterns between the diaphragm of driver 21 and reflector 23, combine together to define the performance qualities of the ultimate objective, namely the acoustical spatial wave shaping which, in turn, describes a hemispherical polar coverage pattern within the system's power bandwidth at a point of summation of approximately eight times the reflector's diameter.

In creating a fully integrated spherical loudspeaker system in accordance with the present invention, while achieving a system having an overall size and shape conforming to the design criteria of the area in which the system is being employed, several principal factors must be established. Once established, these factors control and define the overall dimensions of the system.

In this regard, although optimum performance is always sought, the actual size of the system of the present invention can be controlled, within certain parameters, provided all factors are considered. In creating an optimum sytem, the following formulas should be employed:

Dr=Ds·A, where A ranges between about 1.17 and 1.27

Ds=Dd·B, where B ranges between about 1.9 and 2.1

Dd=λ|c/C, where C ranges between about 24 and 32 and where:

Dr=Reflector diameter

Ds=Sphere diameter

Dd=Driver diameter

λ|c=Wavelength at low frequency cutoff

As is evident from these design defining criteria, a substantial degree of design freedom exists in adjusting the components's size, ratio and proportions while still obtaining a fully functional high performance loudspeaker system in accordance with the present invention. However, although this latitude does exist, care must be exercised in adhering to the standards defined herein in order to assure that a particular system will provide the optimum performance results.

In accordance with the present invention, the cooperation of driver 21, spherical enclosure 22, and reflector 23 establishes the final shape and coverage patterns of all of the frequencies produced by driver 21. By constructing surface 26 of reflector 23 in the manner detailed above, an optimum, highly desirable, hemispherical sound wave pattern is achieved.

Figure 4:
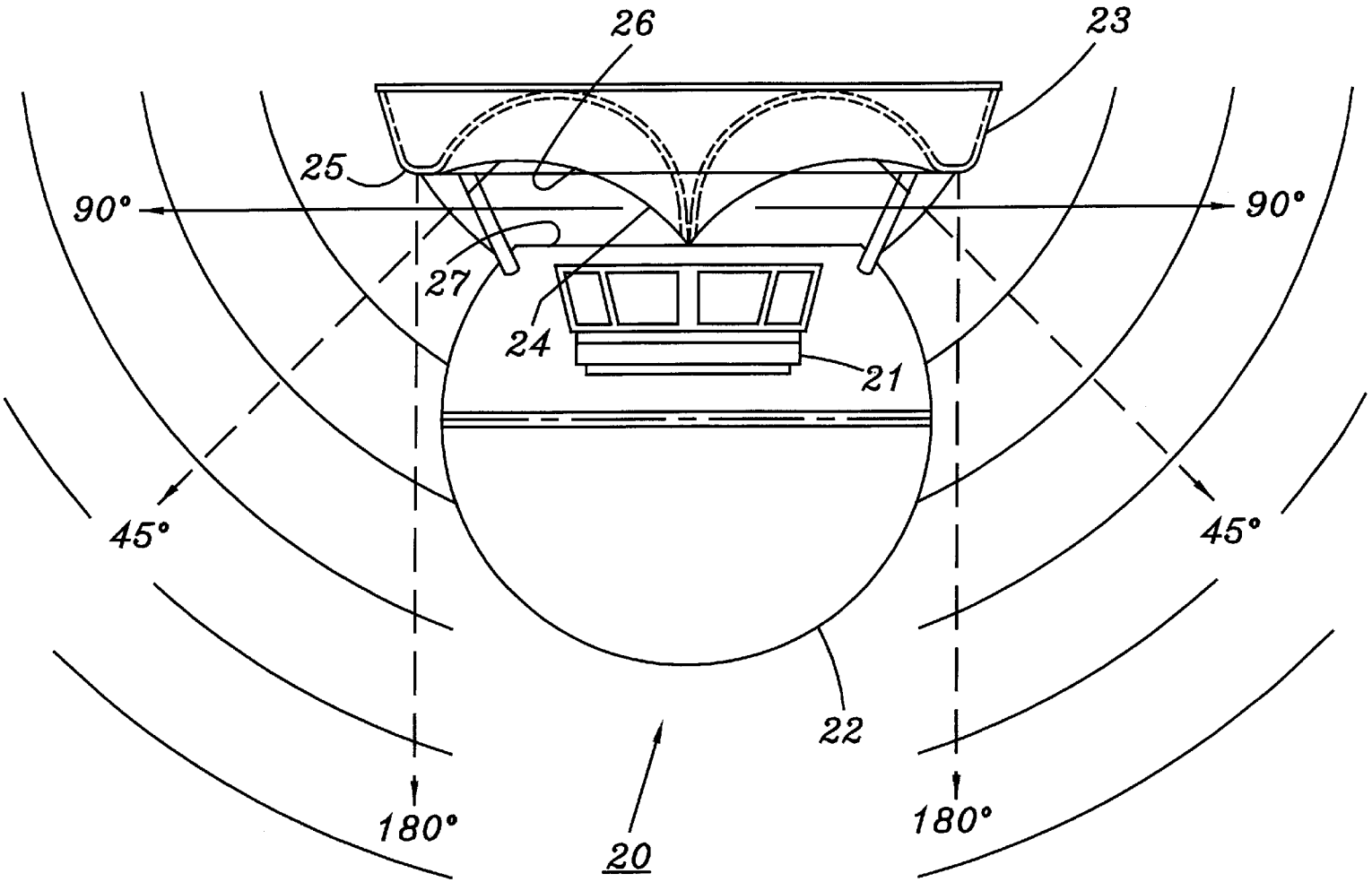
FIG. 4 is a side elevation view, partially in cross-section, depicting the spherical loudspeaker system of the present invention and diagrammatically depicting the acoustical reflection mode phenomenon produced by the present invention.
Figure 5:
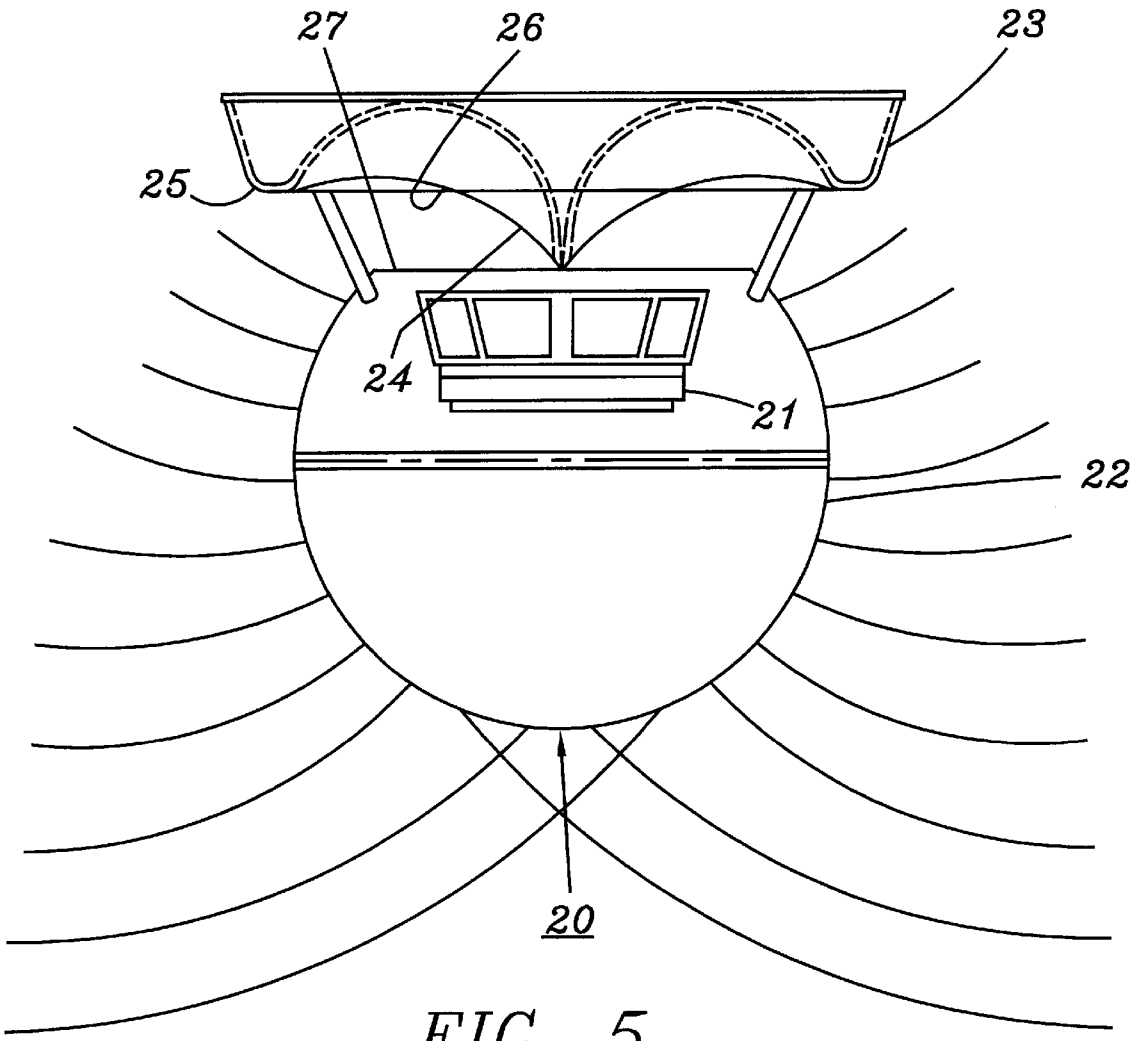
FIG. 5 is a side elevation view, partially in cross-section, depicting the spherical loudspeaker system of the present invention and diagrammatically depicting the edge diffraction mode phenomenon produced by the present invention.

In FIG. 4, the ability of the present invention to produce equal and opposite incidences of reflection of the acoustic energy is clearly depicted. In addition, in FIG. 5, the edge diffraction capabilities of the present invention are shown. As is evident from FIG. 5, spherical enclosure 22 continues with the diffraction effect as the sound energy travels over its surface beyond reflector 23. In addition, complex modes of surface refraction and pressure diffusion also occur between the spherical surface of enclosure 22 and reflector 23.

Acoustical waves expand at variable rates during propagation. The expansion rates and shape depends upon the signal's frequency and the system's associated mechanical parameters. These parameters must be carefully controlled in order to avoid unwanted compression, phase shift, ringing or resonance, cancellations or wave shape distortions. This ideal condition is known as maintaining a linear coupling coefficient through exponential expansion. The converse is also true, and that wave loading or the continuity of wave pressure along its acoustical path must be maintained. The effect achieved by the present invention in regard to its linear unity loading is depicted in FIG. 6.

At some given point in space in front of the speaker, all of the acoustic modes described above intermix in a complementary fashion, to form a unified wave front. This is called the point of summation and generally occurs at a distance of about eight times the reflectors diameter. It is this summation wave, in the shape of a true hemisphere, that gives the loudspeaker system of the present invention the quality of a single source, direct radiator. The wavefront achieved by the present invention is depicted in FIG. 7.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desired to secure by Letters Patent is:

1. A ceiling mounted loudspeaker system for providing a hemispherically shaped, high quality acoustical waveform, said system comprising:

A. a housing comprising a substantially spherical shape and incorporating at least one portal;

B. at least one speaker/driver mounted in said spherically spaced housing in association with the portal thereof;

C. a reflector comprising:

a. a base constructed for being cooperatively mounted with the housing, and b. a generally circular soundwave receiving surface formed on the base and comprising 1. a centrally disposed apex forming the center thereof, 2. an outer rim defining the terminating edge thereof, and 3. a concave shape radially extending between the apex and the rim, defining an exponentially progressive curve which is symmetrical both radially and annularly about the entire circumference of the reflector and conform to the following formula;

$$De=(P_1I)^k, (P_2I)^k \ldots (P_nI)^k$$

where: De Linear axial distance between reflector and sphere at any incremental position along the acoustical path;

and: $P_1, P_2 \ldots P_n$=Linear axial distance of any previous (numbered) De and: $^{k}$=wavelength coefficient factor (in exponential form); Expressed as the expansion factor of the prime parameter $$\frac{AC}{P_L}$$

where: $A_C$=coupling; area of cross section
and: $P_L$=loading; pressure units per area unit
when: I=a fixed linear increment D. said reflector being mounted in cooperating relationship with the housing with the sound wave receiving surface in juxtaposed, spaced, cooperating relationship with the speaker for receiving and reflecting said sound waves in a widely disposed hemispherical pattern.

2. The ceiling mounted loudspeaker system defined in claim 1, wherein the apex of the reflector is further defined as being mounted in close proximity to the speaker/driver.

3. The ceiling mounted loudspeaker system defined in claim 2, wherein the apex of the reflector is further defined as being geometrically coupled to the center of the diaphragm of the driver.

4. The ceiling mounted loudspeaker system defined in claim 1, wherein said housing and said reflector are further defined as being securely mounted to each other by supporting struts.

5. The ceiling the mounted loudspeaker system defined in claim 1, wherein the driver and the housing are further defined as being mounted in cooperating relationship with each other to form an integrated acoustical energy field.

6. The ceiling mounted loudspeaker system defined in claim 1, wherein the acoustical energy field produced by the speaker/driver and housing is further defined as being shaped by the reflector into a true hemispherical pattern, within the power bandwidth of the system.

7. The ceiling mounted loudspeaker system defined in claim 6, wherein the hemispherical pattern produced by the loudspeaker system is further defined as comprising a point of summation substantially equivalent to eight times the diameter of the reflector.

8. The ceiling mounted loudspeaker system defined in claim 1, wherein the speaker/driver is further defined as comprising a high frequency driver and a low frequency driver, each of which are mounted to each other in juxtaposed, spaced, cooperating, relationship.

9. The ceiling mounted loudspeaker system defined and claim 8, wherein the high frequency driver and the low frequency driver are further defined as being coaxially mounted to each other.

10. The ceiling mounted loudspeaker system defined in claim 9, wherein the apex of the reflector is further defined as being geometrically coupled to the center of the diaphragm of the high frequency driver.

11. The ceiling mounted loud speaker system defined in claim 1, wherein said housing and said reflector are further defined as being manufactured from materials selected from the group consisting of fiberglass, plastics, structural foams, aluminum bonded to sound dampening materials, and steel bonded to sound dampening materials.

12. The ceiling mounted loud speaker system defined in claim 11, wherein said housing and said reflector are formed from plastics selected from the group consisting of acrylics, styrene, polyvinylchloride, and polycarbonates.

* * * * *